US010239226B2

(12) United States Patent
Atlagic et al.

(10) Patent No.: US 10,239,226 B2
(45) Date of Patent: Mar. 26, 2019

(54) HAND HELD PLANER

(71) Applicant: Access Tooling PTY LTD, Park Orchards (AU)

(72) Inventors: Peter Atlagic, Hoppers Crossing (AU); Kiki Tanousis, Park Orchards (AU)

(73) Assignee: Access Tooling PTY LTD, Park Orchards (AU)

( * ) Notice: Subject to any disclaimer, the term of this patent is extended or adjusted under 35 U.S.C. 154(b) by 794 days.

(21) Appl. No.: 14/391,831

(22) PCT Filed: Apr. 11, 2013

(86) PCT No.: PCT/AU2013/000372
§ 371 (c)(1),
(2) Date: Oct. 10, 2014

(87) PCT Pub. No.: WO2013/152394
PCT Pub. Date: Oct. 17, 2013

(65) Prior Publication Data

US 2015/0075014 A1 Mar. 19, 2015

Related U.S. Application Data

(60) Provisional application No. 61/711,221, filed on Oct. 9, 2012.

(30) Foreign Application Priority Data

Apr. 11, 2012 (AU) ..... 2012901417

(51) Int. Cl.
*B27C 1/10* (2006.01)
*B27C 1/02* (2006.01)
(Continued)

(52) U.S. Cl.
CPC ..... *B27C 1/10* (2013.01); *B27G 17/02* (2013.01)

(58) Field of Classification Search
CPC .... B27C 1/10; B27C 1/02; B27C 1/14; B27G 17/025; B27G 17/02
See application file for complete search history.

(56) References Cited

U.S. PATENT DOCUMENTS 1,567,342 A * 12/1925 Szako ..... B27G 17/02 30/478
1,641,645 A * 9/1927 Skolnik ..... B27C 1/005 144/119.1
(Continued)

FOREIGN PATENT DOCUMENTS

CN 85205857 U 7/1987
CN 2361447 Y 2/2000
(Continued)

*Primary Examiner* — Sean Michalski
*Assistant Examiner* — Fernando Ayala

(57) ABSTRACT

The invention provides a hand held planer (1) for planing a work piece surface comprising a planing tool (41) disposed between a first base (20) and a second base (30,31), the planer (1) being configurable so that it can be moved by hand along the work piece surface with the first base (20) leading and the first (20) and second (30,31) bases guiding the planer (1) along the work piece surface and the planing tool planing off a thickness of the work piece, wherein at least one (30,31) of the bases is an adjustable base such that at least a portion (31) thereof is removable or movable between a position that provides an operable lengthened configuration and a position that provides an operable shortened configuration such that a length of the adjustable base in guiding contact with the work piece surface is reduced or eliminated in the shortened configuration compared to the lengthened configuration.

14 Claims, 5 Drawing Sheets

(51) Int. Cl.
*B27C 1/14* (2006.01)
*B27G 17/02* (2006.01)

(56) References Cited

U.S. PATENT DOCUMENTS

| | | | | |
|---|---|---|---|---|
| 2,383,841 | A | 8/1945 | Benn | |
| 3,499,365 | A * | 3/1970 | Needham | B23C 3/28 144/134.1 |
| 4,584,772 | A * | 4/1986 | Bergler | B23Q 9/0028 30/475 |
| 6,615,497 | B1 | 9/2003 | Saunders | |
| 7,530,173 | B2 * | 5/2009 | Economaki | B27G 17/02 30/481 |
| 2008/0289723 | A1 * | 11/2008 | Janzen | B27C 1/10 144/137 |

FOREIGN PATENT DOCUMENTS

| | | | |
|---|---|---|---|
| CN | 2567010 | Y | 8/2003 |
| CN | 101111352 | A | 1/2008 |
| DE | 3807878 | C2 | 6/1995 |
| DE | 10238756 | | 3/2004 |
| GB | 124685 | | 4/1919 |
| GB | 1371524 | A | 10/1974 |
| JP | 1984-227401 | | 12/1984 |

* cited by examiner

HAND HELD PLANER

FIELD

The present invention relates to improvements in hand held planers such as electric wood planers for shaving small amounts of wood stock from a door, frame or other work piece as may be required for small adjustments in thickness. More particularly, the present invention relates to a planer having a section or sections of its base that can be repositioned upon the planer or removed in their entirety.

Although the background, objects and preferred embodiments of the invention will be hereinafter described with reference to a hand held, electrically powered, wood planer for shaving wood stock of, 15 to 80 mm breadth from a wooden structure that may be located in a confined space or near an obstruction in a room under renovation or construction, it is to be understood that the invention is not limited thereto but potentially has wider application.

BACKGROUND

Hand held, electrically powered, wood planers are well known in the art. Conventionally, such wood planers comprise a housing in which is located an electric motor and a major portion of a cylindrical rotatable planing tool to which power can be transmitted from the motor.

An opening is provided at the bottom of the housing near the middle of the planer for allowing a minor portion of the planing tool to project therefrom. This opening is usually rectangular, but it may take a plurality of regular or irregular shapes.

The rotational motion of the planing tool generates a circular cutting motion known as the cutting circle. The section of the cutting circle that impinges onto a work piece is known as the cutting arc.

The bottom of the planer is provided by a base comprising two base plates extending from either side of the cutting arc of the planing tool, with a small amount of clearance maintained between each base plate and the cutting arc of the planing tool.

The base plates provide a means for contacting the work piece and thus stabilising the planer in operation.

The planer is held in a manner, when operated, whereby the planing tool rotates on an axis parallel to the plane of the work piece to be planed.

The planer is operated in a single direction with the unplaned portion of the work piece contacting the leading base plate and the planed portion of the work piece contacting the trailing base plate.

The extent by which the cutting arc of the planing tool can impinge on a work piece is determined by its location relative to the leading base plate. Typically the base plate can be raised or lowered to determine the depth of cut, that is to say, to allow for the removal of, say, between 0.1 mm and 3 mm of wood stock in a single pass against a work piece. One or more passes against a work piece are made until a required thickness or amount of wood stock has been shaved or planed away.

In operation, an electric wood planer will first contact the work piece with the leading base plate, then with the cutting arc of the planing tool, and finally with the trailing base plate. The planer will then typically leave the work piece in the same order, with the final contact being between work piece and the trailing base plate.

In this manner, the leading base plate stabilises the planer as the planing tool approaches the start of the work piece and the trailing base plate stabilises the planer as the planing tool clears the end of the work piece.

Both leading and trailing base plates are used to stabilise the planer after initiation and before termination of the work piece, with the operator tending to apply the majority of pressure to the rear of the planer such that the planer is pushed forwards from a position behind the planing tool as opposed to being pulled forwards from a position ahead of the planing tool. Correspondingly, it is conventional that the trailing base plate tends to be larger than the leading base plate in many electric planers.

The planer is held in a manner, when operated, whereby the tool rotates on its axis and numerous passes against a work piece are made until a required thickness or amount of wood stock has been shaved or planed away. Such wood planers are effective when operating in open, unobstructed spaces, but are ill suited for operating in confined spaces or near an obstruction because of the restrictions imposed by the length of the base plates, and where small amounts of wood stock may need to be shaved.

Where there is an obstruction close to the start of the work piece the position of the trailing base plate limits the positioning of the cutting arc, and thereby the initiation of planing, to a point beyond the start of the work piece.

Initiating planing by plunging the planing tool straight into the work piece at some position a distance away from the conventional starting point is both difficult, since the trailing base plate is conventionally in line with the cutting arc of the planing tool, and unhelpful since this leaves a substantial amount of wood stock between the plunge point and the start of the work piece still to be removed by other means.

By limiting the size of the trailing base plate the cutting arc can be brought closer to the start of the work piece. However, an absent or minimal trailing base plate makes termination of planing at the end of the work piece both difficult and potentially hazardous, since the trailing base plate performs an important role in stabilising the planer at the end of the planing process.

Where there is an obstruction close to the end of the work piece the position of the leading base plate limits the positioning of the cutting arc and thereby the termination of planing to a point before the end of the work piece.

By limiting or truncating the size of the leading base plate the cutting arc can be brought closer to the end of the work piece. However, an absent or minimal leading base plate makes initiation of planing both difficult and potentially hazardous, since the leading base plate performs an important role in stabilising the planer at the start of the planing process. Further, since positioning of the leading base plate is the principal means by which the depth of cut can be controlled its complete removal is not practical.

Presently, when it is necessary to shave wood stock from the top or side of a door for a proper fit with the door frame, a tradesman using a conventional wood planer will often need to firstly remove the door and operate the planer in more open space, before rehanging the door. This task is laborious, and time consuming, and bears the risk of handling damage.

Furthermore, for shaving wood stock from a bowed or misaligned framing stud or stud noggin located near an obstruction, use of a conventional wood planer may not be possible and instead a hammer and a chisel may be required. This may be particularly important when trying to bring the edges of a plurality of framing studs into alignment for the proper installation of drywall panels or tile underlay sheets without the panels or sheets becoming twisted or bowed.

Although a hammer and chisel may be used for this purpose, they are both laborious and time consuming, and require a high degree of skill.

It has been found by the present inventors that none of the prior art apparatus and methods provide an effective, stable and unhazardous means of shaving or planing small amounts of wood stock from a door, framing stud, stud noggin or other work piece as may be required for small adjustments in thickness in confined spaces or near an obstruction, whether the confinement or obstruction is located at the start or at the end of the work piece.

There is therefore a need to provide an improved planer that overcomes one or more of the abovementioned disadvantages.

SUMMARY OF THE INVENTION

According to a broad aspect of the invention there is provided a hand held planer for planing a work piece surface comprising a planing tool disposed between a first base and a second base, the planer being configurable so that it can be moved by hand along the work piece surface with the first base leading and the first and second bases guiding the planer along the work piece surface and the planing tool planing off a thickness of the work piece, wherein at least one of the bases is an adjustable base such that at least a portion thereof is removable or movable between a position that provides an operable lengthened configuration and a position that provides an operable shortened configuration such that a length of the adjustable base in guiding contact with the work piece surface is reduced or eliminated in the shortened configuration compared to the lengthened configuration.

In one embodiment, the length of the adjustable base in the shortened configuration is less than half the length of the adjustable base in the lengthened configuration.

In one embodiment, the portion of the adjustable base is removable entirely from the planer. The portion may be removable entirely from the planer by a sliding engagement between the portion of the adjustable base and a housing attached to a remaining portion of the base.

In one embodiment, the portion of the adjustable base is movable between the shortened and lengthened configurations while remaining attached to the planer.

In different embodiments, the portion of the adjustable base is at least partly slidable or at least partly rotatable between the shortened and lengthened configurations while remaining attached to the planer. In one embodiment, the portion of the adjustable base is on the second base and comprises left and right parts that are rotatable around opposite sides of the planer towards the first base to provide the shortened configuration In one embodiment, the planer further comprises a handle movable in a longitudinal direction between at least two positions each adapted for use in the shortened and lengthened configurations respectively. The handle may prevent movement of the portion into the shortened configuration when the handle is in the position adapted for use in the lengthened configuration.

In one embodiment, when in the shortened configuration, at least the first base and the planing tool are disposed in an integrated housing.

In one embodiment, when in the shortened configuration, the planer is shaped on a trailing end so that:

the trailing end can be rested on a floor with the first base perpendicular to the floor and in line with the work piece surface which is vertically oriented such as the edge of a hung door; and the planing tool is positioned within the planer to plane the work piece from a location close to the floor.

In one embodiment, both first and second bases have the movable or removable portions. The portions of both bases may comprise a relocatable base portion which is adapted to be relocated between a position forming part of the second base and a position forming part of the first base. The relocatable base portion may be hinged on the planer so as to be rotatable, and may be formed in left and right parts that are rotatable around opposite sides of the planer.

In one embodiment, the planing tool is a motor driven cylindrically mounted planing tool.

In one embodiment, the second base is the adjustable base and the portion of the second base is completely removable. The second base may be disposed on a removable piece and the first base may be disposed with the planing tool in a housing, and the removable piece may comprise a rear part of a handle and the housing may comprise a front part of the handle. The removable piece may be attached to the housing by a cooperating hook and recess arrangement together with a screw in the removal piece engaging with a threaded recess in the housing.

In one embodiment, the removable portion of the second base is the entire second base, thereby facilitating plunge planing.

DETAILED DESCRIPTION OF EMBODIMENTS

An embodiment of the current invention will now be described.

Figure 1:
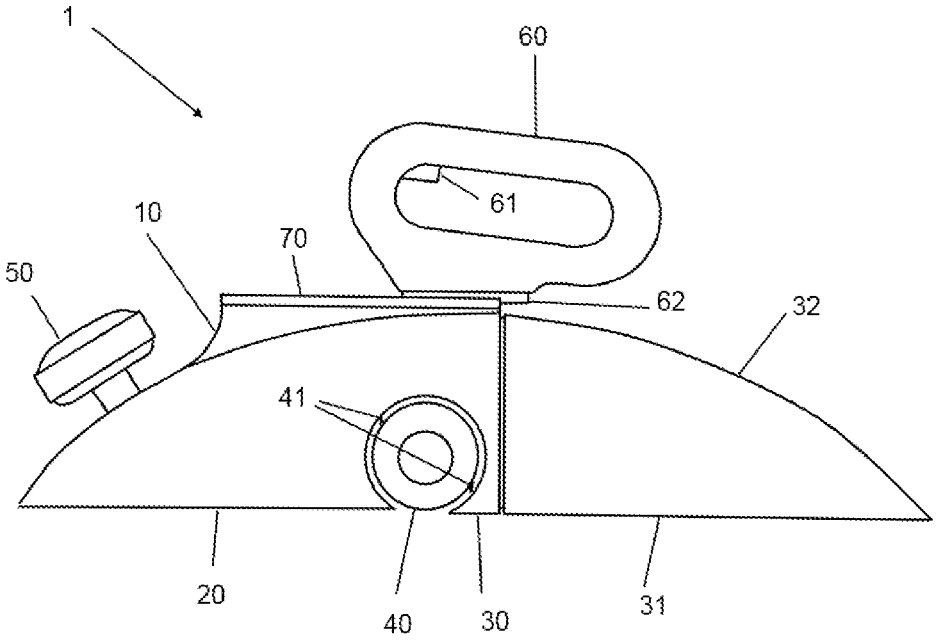
FIG. 1 is a side view of a planer according to an embodiment of the current invention in a lengthened configuration and its handle in a rear-most position.

Referring first to FIG. 1, there is shown a planer 1 comprising a housing 10. Disposed within the housing 10 is a first base 20 and a cylindrical electrically powered planing tool 40 with tool tips or planer blades 41 for planing off a thickness of a work piece.

A second base in a trailing disposition to planing tool 40 is an adjustable base, being a composite of juxtaposed portions 30 and 31. Portion 31 provides the adjustment, being a removable portion forming part of a removable piece 32, the operation of which will be described later.

Planer 1 further comprises a knob 50 and handle 60 with trigger 61 to operate the planing tool 40. A user holds handle 60 in one hand and knob 50 in the other hand, and moves the planer along a work piece surface with first base 20 leading and second base 30,31 trailing, with first base 20 and second base 30, 31 guiding the planer along the work piece surface, and the tool tips 41 planing off a thickness of the work piece.

Handle 60 is movable by an elongate projection 62 adapted to slide in a slot 70. In this lengthened configuration, handle 60 is shown most conveniently positioned along slot 70 in a trailing position.

Planer 1 has dimensions in this configuration similar to a conventional electric planer, with planing tool 40 disposed between leading first base 20 and trailing second base 30,31 having comparable lengths, and handle 60 in a balanced position.

Figure 2:
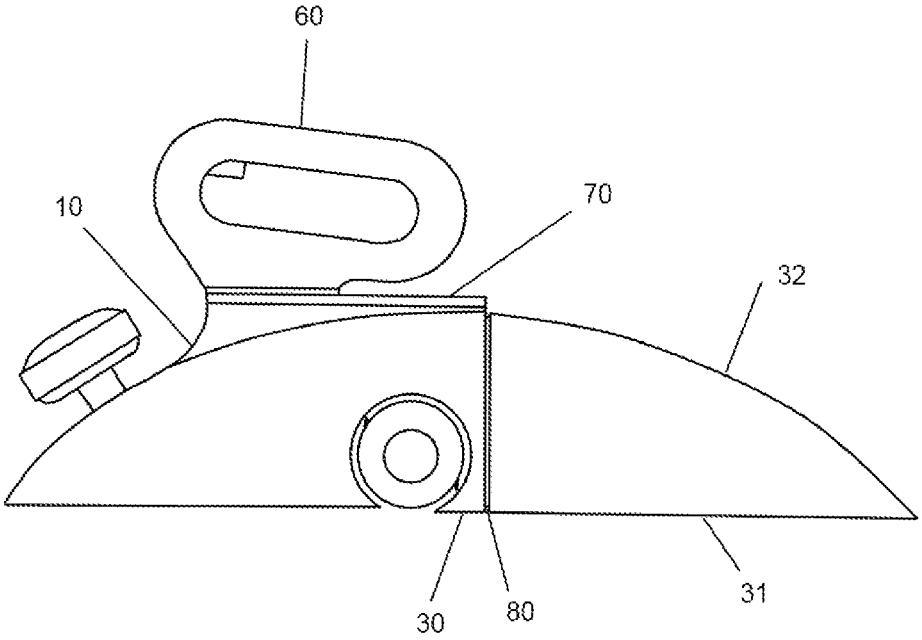
FIG. 2 is a side view of the planer of FIG. 1 with handle shifted to a front-most position.

Now referring to FIG. 2, planer 1 is shown with handle 60 moved along slot 70 into a leading position. In this position, portion 31 of the adjustable composite second base 30, 31 is removable by sliding projection 80 upwards, which slidably engages with housing 10 in a slot, so as to remove the removable piece 32 completely from housing 10.

Figure 3:
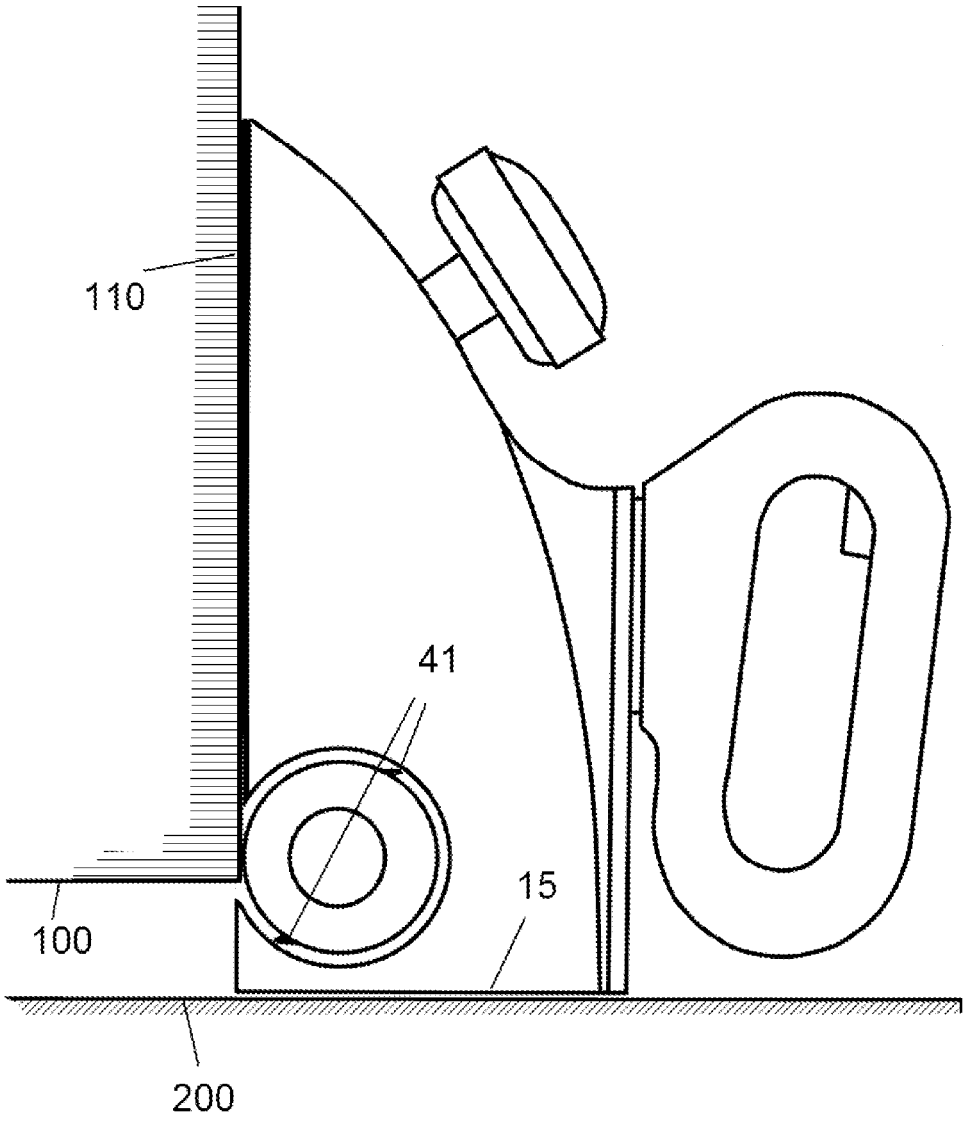
FIG. 3 is a view of the planer of FIG. 1 in a shortened configuration planing the edge of a door in situ.

Now referring to FIG. 3, planer 1 is shown in the shortened configuration with removable portion 31 of the second base removed and the second base being provided by only the very short remaining portion 30 disposed within housing 10. The drawing shows the planer in the course of a planing task comprising planing a vertical edge 110 of a door 100 from a position close to a floor 200. As can be seen, the planer is shaped so that a trailing end 15 can be rested on the floor 200 with the first base 20 perpendicular to the floor 200 and inline with the vertically oriented work piece surface 110. The tool tips 41 are positioned within the housing so that they can plane from a location close to the floor, as is common for the bottom of hung doors.

Figure 4:
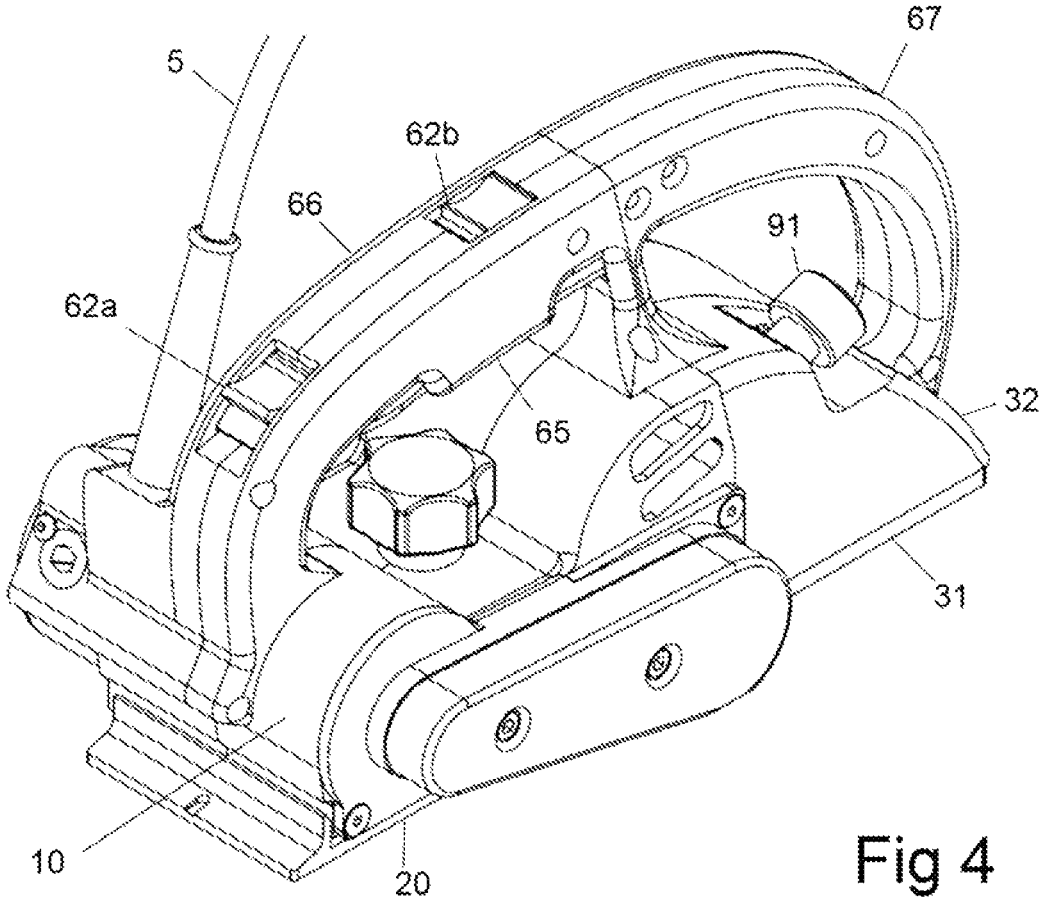
FIG. 4 is a perspective view of a planer according to a production prototype embodiment of the current invention.
Figure 5A:
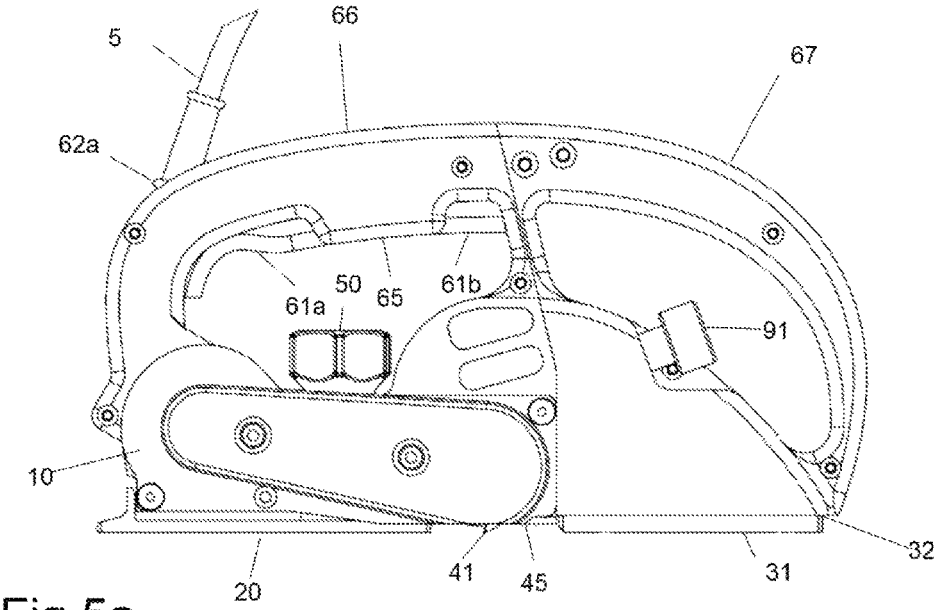
FIGS. 5*a* and 5*b* are side views of the planer of FIG. 1 in an opaque and semi transparent depiction respectively.
Figure 5B:
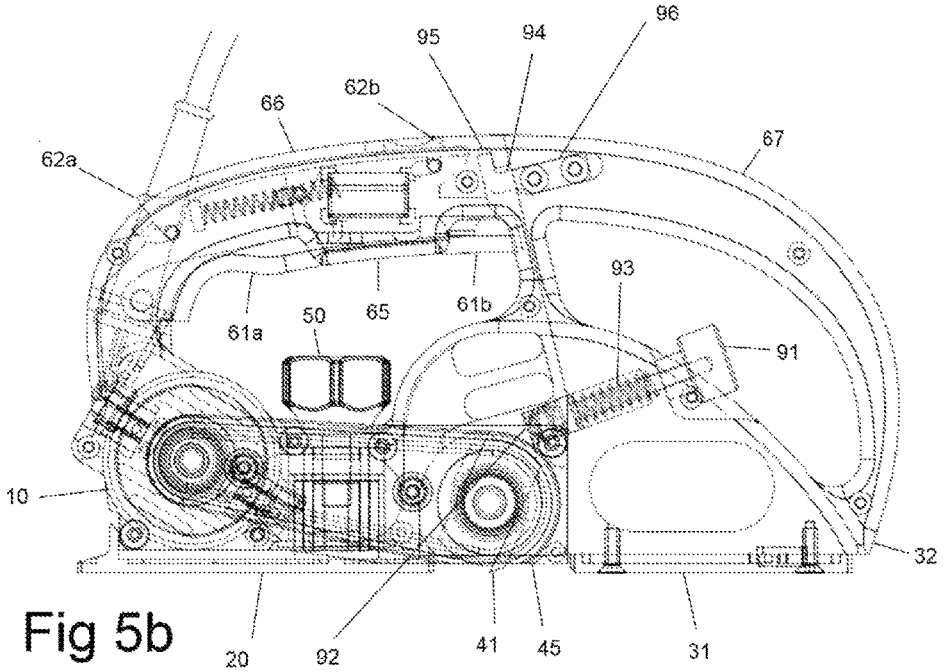

Now referring to FIGS. 4, 5*a* and 5*b* where appropriate, a production prototype embodiment of a planer according to the current invention is shown. As in the embodiment of FIG. 1, the planer comprises a housing 10 having a first base 20 and a cylindrical electrically powered planing tool with tool tips 41. The second base 31 is part of a removable piece 32, and in this embodiment the removable portion of the second base 31 is the entire second base 31, there being no remaining portion 30 of the second base within the housing, instead a back of the housing 45 behind the cylindrical planing tool is recessed and does not engage the work piece. This version allows complete freedom in starting the planing action when the removable piece 32 is removed, by plunging into the middle of a flat surface when the edge is not accessible, such as near the corner of a window frame, as the absence of a remaining portion 30 no longer prevents the tool from cutting to the depth determined by the position of the leading first base 20.

This embodiment also features a two-piece handle 66 and 67, obviating the need for a sliding handle as in the first embodiment. Further, the trigger in this embodiment is into pieces 61*a* and 61*b* to enable comfortable operation in both the lengthened and shortened configuration, together with a fixed non-trigger portion 65 therebetween to enable gripping of the handle and holding the planer without activating the trigger. A safety switch is also provided operable by forwards sliding from two activators 62*a* and 62*b* for the same reasons of convenience of operation in both configurations. Removable piece 32 is secured by a brass screw 91 and a hook 94. Removable piece 32 is removed by unscrewing the screw 91 from its screw threaded brass recess 92 in the housing 10 and then rotating the removable piece 32 about hook 94 away from the housing and withdrawing hook 94 from recess 95 in the housing 10. Hook 94 is fixed inside removable portion 32 by an aluminium insert 96 to assist with strengthening. Screw 91 is biased by spring 93 in an extended position, to assist with alignment into the screw threaded recess 92 when reconnecting to the housing 10 to reform the lengthened configuration.

Details of the sliding or other engagement of the piece 32 with removable base portion 31 with respect to housing 10 and locking mechanisms in relation thereto are commonly understood features of engineering design and may be realised in many different well known ways.

The invention thus provides the advantages of a planer with a shortened configuration that allows planing from difficult positions such as the bottom of a hung door, combined with the stability advantages in a lengthened configuration of a conventional planer.

Persons skilled in the art will also appreciate that many variations may be made to the invention without departing from the scope of the invention.

For example, in other embodiments, the removable portion can be part of the leading first base or the trailing second base or both.

Further, the removable portion or portions of the adjustable base or bases may be movable rather than removable, and may be rotatable to move between the shortened and lengthened configurations.

Further still, it is to be understood from the above embodiments that the remaining portion 30 of the embodiment described may be removed altogether with the planing block protruding from the opening. To this end, the removable portion can be all of the trailing base, and throughout this specification, the word "portion" in relation to an adjustable base is intended to extend to the situation where the portion is the entire base, unless the context specifically requires otherwise. Such a variation allows complete freedom in starting the planing action by plunging into the middle of a flat surface when the edge is not accessible, such as near the internal corner of a window frame, as once removed the remaining portion 30 no longer prevents the tool from cutting to the depth determined by the position of the leading first base 20. An alternative configuration to achieve a similar aim is where the remaining portion 30 is still present, but is disposed at the same height as the leading first base 20, so that the cutting tool may cut unimpeded to its intended depth when plunged into the middle of the flat surface.

In one variant of a rotatable movable portion, there may be provided a relocatable base portion which is hinged on the plane and so as to be rotatable around the planer about an axis perpendicular to the bases from the first base to the second place, so that when it forms part of the first base, the first based is in a lengthened configuration and the second base is in a shortened consideration; and when it forms part of the second base, the second base is in a lengthened configuration and the first space is in a shortened configuration.

In a further variant, the movable portion is at least partly slidable between the shortened and lengthened configurations while remaining attached to the planer, in a telescopic arrangement.

Although the embodiment described is in relation to an electric planer, the ideas of the invention can be equally applied to a manual planer.

The terms "first base" and "second base" in this specification refer to guiding parts in a leading and trailing disposition with respect to the planing tool, and may be part of an integral unit, particularly in the shortened configuration.

The term "adjustable base" in this specification and the claims refers to the ability to remove or reposition one of the bases to change between the shortened and the lengthened configuration, and is not be confused with height adjustment of a base in the conventional manner to vary the cutting depth of the planer.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The invention claimed is:

1. A hand held planer for planing a work piece surface comprising:

a. a housing having a leading first base, a housing bottom surface for contacting the work piece surface, a housing back surface, and a planing tool adjacent to the back surface of the housing such that the back surface of the housing is trailing behind the planing tool; and b. a second base in a trailing disposition to the housing, wherein the second base has a front surface configured to attach to the housing back surface, and a second base bottom surface for contacting the work piece surface, wherein the front surface meets the bottom surface of the second base to share a common edge, wherein the planing tool is disposed between the first base and the second base, the planer being configurable so that it can be moved by hand along the work piece surface with the first base leading, the second base trailing entirely behind the housing back surface, and the first and second bases guiding the planer along the work piece surface and the planing tool planing off a thickness of the work piece, wherein the second base is adjustable such that the second base is removable or movable between a position that provides an operable lengthened configuration to the planer and a position that provides an operable shortened configuration to the planer such that a length of the second base in guiding contact with the work piece surface is eliminated in the shortened configuration compared to the lengthened configuration, wherein, when in the lengthened configuration, the front surface of the second base is attached to the back surface of the housing, wherein, when in the shortened configuration, the first base and the planing tool are disposed in the housing and the planing tool is positioned within the housing at or near a trailing end of the housing back surface and the first base is leading the planing tool.

2. A hand held planer as claimed in claim 1 wherein the second base is removable entirely from the planer, thereby facilitating plunge planing.

3. A hand held planer as claimed in claim 1 wherein the second base is removable entirely from the planer by a sliding engagement between the second base and the housing attached to a remaining portion of the second base.

4. A hand held planer as claimed in claim 1 wherein the second base is movable between the shortened and lengthened configurations while remaining attached to the planer.

5. A hand held planer as claimed in claim 1 wherein the second base is at least partly slidable between the shortened and lengthened configurations while remaining attached to the planer.

6. A hand held planer as claimed in claim 1 wherein the second base is at least partly rotatable between the shortened and lengthened configurations while remaining attached to the planer.

7. A hand held planer as claimed in claim 1 wherein the second base comprises left and right parts that are rotatable around opposite sides of the planer towards the first base to provide the shortened configuration of the second base.

8. A hand held planer as claimed in claim 1 further comprising a handle movable in a longitudinal direction between at least two positions each adapted for use in the shortened and lengthened configurations respectively.

9. A hand held planer as claimed 9, wherein the handle prevents movement of the second base into the shortened configuration when the handle is in the position adapted for use in the lengthened configuration.

10. A hand held planer as claimed in claim 1 wherein, when in the shortened configuration, the planer is shaped on the trailing end so that:

the trailing end can be rested on a floor with the first base perpendicular to the floor and in line with the work piece surface which is vertically oriented; and the planing tool is positioned within the planer at or near the trailing end to plane the work piece from a location close to the floor.

11. A hand held planer as claimed in claim 1 wherein the planing tool is a motor driven cylindrically mounted planing tool.

12. A hand held planer as claimed in claim 10 wherein the second base is completely removable.

13. A hand held planer as claimed in claim 12 wherein the second base is disposed on a removable piece and the first base is disposed with the planing tool in the housing, and the removable piece comprises a rear part of a handle and the housing comprises a front part of the composite handle.

14. A hand held planer as claimed in claim 13 wherein the removable piece is attached to the housing by a cooperating hook and recess arrangement together with a screw in the removable piece engaging with a threaded recess in the housing.

* * * * *